United States Patent [19]

Weiland

[11] 4,125,906

[45] Nov. 21, 1978

[54] TOILET VENTILATING APPARATUS

[76] Inventor: George G. Weiland, 520-1st St. SE., Hampton, Iowa 50441

[21] Appl. No.: 882,119

[22] Filed: Feb. 28, 1978

Related U.S. Application Data

[63] Continuation of Ser. No. 778,345, Mar. 17, 1977, abandoned.

[51] Int. Cl.[2] ..... E03D 9/052

[52] U.S. Cl. ..... 4/217; 4/213

[58] Field of Search ..... 4/213, 217

[56] References Cited

U.S. PATENT DOCUMENTS

| | | | |
|---|---|---|---|
| 1,372,272 | 3/1921 | Bruder | 4/217 |
| 2,849,727 | 9/1958 | Bollinger et al. | 4/217 |
| 2,988,756 | 6/1961 | Hartley | 4/213 |
| 3,108,289 | 10/1963 | Smith | 4/213 |
| 3,916,459 | 11/1975 | Ivanceric | 4/213 |

*Primary Examiner*—Charles E. Phillips

*Attorney, Agent, or Firm*—Zarley, McKee, Thomte, Voorhees & Sease

[57] ABSTRACT

A toilet ventilating apparatus comprising a seat portion having hinged means for securement to a toilet bowl, a peripheral conduit extending around and through the seat and being closed except for a port adjacent the hinge means and a port opposite the hinge means connecting the conduit with the interior of the bowl, and an exhaust fan in communication with the peripheral conduit through an exhaust conduit for withdrawing air from the bowl through the ports, through the peripheral conduit, and out the exhaust conduit.

1 Claim, 4 Drawing Figures

TOILET VENTILATING APPARATUS

This is a continuation of application Ser. No. 778,345 filed Mar. 17, 1977 now abandoned.

BACKGROUND OF THE INVENTION

Various means have been proposed for drawing foul air from washrooms and the like and discharging same into the outside atmosphere. The conventional practice is to provide a ventilation fan in the ceiling of the room. This method, however, requires the movement of a large volume of air to fully ventilate the washroom and toilet bowl.

The main object of this invention is to provide a toilet ventilating apparatus which will remove air from the interior of the toilet bowl quickly and expell it directly into the outside atmosphere.

A further object is to provide a toilet ventilating apparatus which may be fitted to any conventional toilet bowl in the same manner as a normal seat.

A still further object of the invention is to provide a toilet ventilating apparatus which is economical to manufacture and durable in use.

SUMMARY OF THE INVENTION

A toilet ventilating apparatus is disclosed wherein a peripheral conduit extends around and through a toilet seat with one port adjacent the toilet seat hinge and another port opposite the hinge to connect the conduit with the interior of the toilet bowl and an exhaust conduit in communication with the peripheral conduit and an exhaust fan so as to withdraw air from the toilet bowl through the ports, through the peripheral conduit and out the exhaust conduit.

DESCRIPTION OF THE PREFERRED EMBODIMENT

Figure 1:
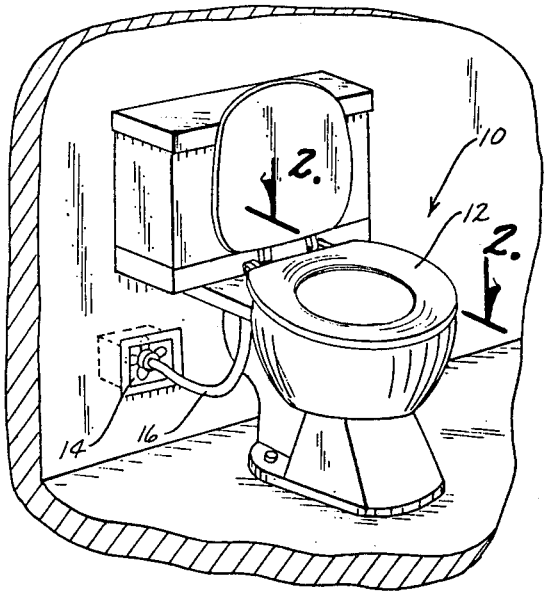
FIG. 1 is a perspective view of the invention mounted on a conventional toilet bowl.

The toilet ventilating apparatus 10 is general comprised of a seat portion 12, an exhaust fan 14, and exhaust conduit 16, and a hinge 18.

Figure 2:
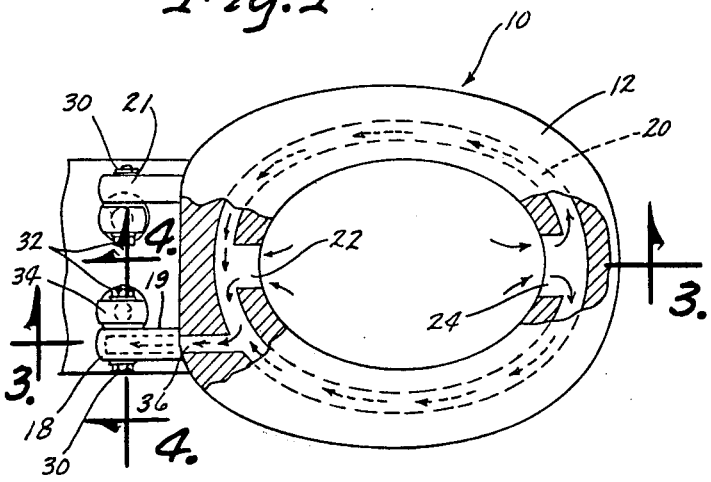
FIG. 2 is a view seen on lines 2 — 2 of FIG. 1 with a portion broken away and with the broken lines indicating the peripheral conduit.
Figure 4:
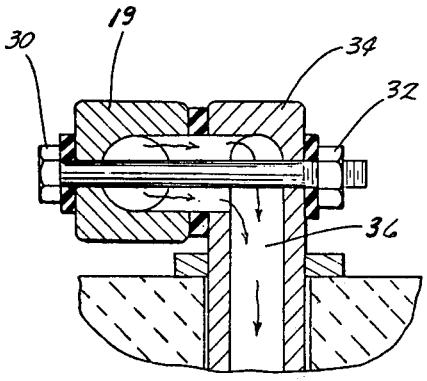
FIG. 4 is an enlarged sectional view seen on line 4 — 4 of FIG. 2.
Figure 3:
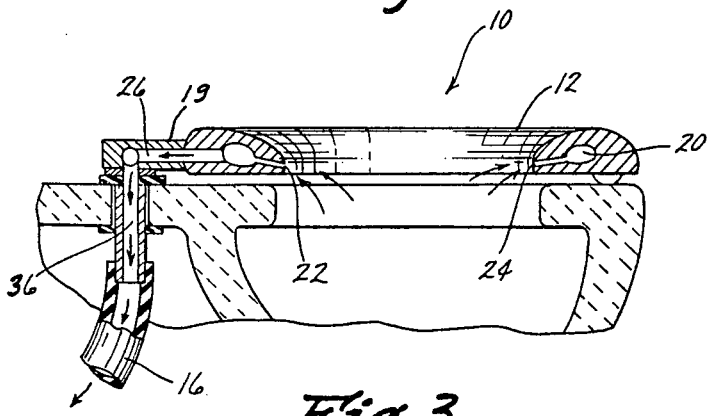
FIG. 3 is an enlarged sectional view seen on line 3 — 3 of FIG. 2.

Seat portion 12 is of conventional shape so as to be easily fitted to a conventional toilet bowl as shown in FIG. 1, and has a pair of rearwardly or outwardly extended support arms 19 and 20 and a peripheral conduit 20 extending around and through said seat portion 12 as seen in FIGS. 2 and 3. Peripheral conduit 20 contains intake port 22, adjoining hinge 18 and intake port 24, opposite port 22 with both ports opening into the interior of the toilet bowl as shown in FIG. 3. Having only front and back intake ports provides high efficiency in removing air from the toilet bowl. A first passageway 26 extends through support arm 19 and seat portion 12 for communication with said peripheral conduit 20. Hinge 18 pivotally secures seat 12 to a conventional toilet bowl and comprises bolts 30, nuts 32, upright support posts 34 and 35 and a second passageway 36 extended generally axially through post 34 as shown in FIG. 4. The second passageway 36 is disposed in communication with said first passageway 26 so as to connect peripheral conduit 20 to exhaust conduit 16 as shown in FIG. 3. Exhaust conduit 16 is connected to exhaust fan 14 such that foul air from the interior of the toilet bowl is efficiently drawn by exhaust fan 14 into ports 22 and 24, through peripheral conduit 20, first and second passageways 26 and 36, and exhaust conduit 16 to the atmosphere.

As can be seen, this toilet ventilating apparatus accomplishes at least all of its stated objectives.

I claim:

1. The combination comprising, a toilet bowl having an open upper peripheral portion, a seat portion extending over said upper peripheral portion of said bowl and having a pair of outwardly extended support arms for pivotal securement to said bowl, each support arm having a first bolt receiving aperture therein, a peripheral conduit extending around and through said seat portion, said peripheral conduit being closed except for a first port adjacent said support arms and a second port opposite said first port, said ports connecting said conduit with the interior of said bowl, one of said pair of support arms having a first passageway therethrough in communication with said peripheral conduit, a hinge means including a pair of upright support posts each having a second bolt receiving aperture rigidly connecting each support arm by a bolt passing through said first and second apertures and a nut engaged with each bolt to pivotally secure said seat portion to said bowl, one of said support posts having a second passageway extended generally axially therethrough and disposed in closed communication with said first passageway by said nut and bolt, said bolt extending through at least a portion of said onesupport arm, said first passageway, said second passageway and said one support post, an exhaust conduit connected to said second passageway, and an exhaust fan means in communication with said exhaust conduit so that air is withdrawn from said bowl through said ports, said peripheral conduit, said first passageway, said second passageway and said exhaust conduit by said fan means.

* * * * *